US011807436B2

(12) United States Patent
Lamoureux

(10) Patent No.: US 11,807,436 B2
(45) Date of Patent: Nov. 7, 2023

(54) TETHERED PLASTIC SCREW STOPPER

(71) Applicant: NOVEMBAL USA INC., Edison, NJ (US)

(72) Inventor: Richard Lamoureux, Rawdon (CA)

(73) Assignee: NOVEMBAL USA INC.

( * ) Notice: Subject to any disclaimer, the term of this patent is extended or adjusted under 35 U.S.C. 154(b) by 254 days.

(21) Appl. No.: 17/290,949

(22) PCT Filed: Nov. 4, 2019

(86) PCT No.: PCT/US2019/059712
§ 371 (c)(1),
(2) Date: May 3, 2021

(87) PCT Pub. No.: WO2020/093062
PCT Pub. Date: May 7, 2020

(65) Prior Publication Data
US 2021/0387778 A1 Dec. 16, 2021

(51) Int. Cl.
*B65D 55/16* (2006.01)
*B65D 41/34* (2006.01)

(52) U.S. Cl.
CPC ..... *B65D 55/16* (2013.01); *B65D 41/34* (2013.01); *B65D 2401/30* (2020.05)

(58) Field of Classification Search
CPC ..... B65D 55/16; B65D 41/34; B65D 2401/30
See application file for complete search history.

(56) References Cited

U.S. PATENT DOCUMENTS

| | | | | |
|---|---|---|---|---|
| 3,904,062 | A * | 9/1975 | Grussen | B65D 55/16 215/258 |
| 4,394,918 | A | 7/1983 | Grussen | |
| 4,546,892 | A | 10/1985 | Couput | |
| 4,565,293 | A | 1/1986 | Jonas | |
| 4,805,792 | A * | 2/1989 | Lecinski, Jr. | B65D 55/16 215/253 |
| 5,215,204 | A | 6/1993 | Beck | |
| 5,725,115 | A * | 3/1998 | Bosl | B65D 41/3428 215/258 |
| 6,308,848 | B1 | 10/2001 | Parrinello | |
| 6,464,093 | B1 | 10/2002 | Takano | |
| 10,654,625 | B2 * | 5/2020 | Migas | B65D 41/3428 |

(Continued)

OTHER PUBLICATIONS

International search report dated Jan. 2, 2020.
European search report dated Aug. 12, 2022 for EP App. No. 19880856.

*Primary Examiner* — James N Smalley

(57) ABSTRACT

The present invention relates to tethered plastic stopper having a closure shell and a tamper band connected to the closure shell by bridges that connect a bottom edge of the closure shell to a top edge of the tamper band. The stopper includes a ridge forming a link that separably connects the closure shell and the tamper band by a weakness line containing a plurality of first bridges and the at least one second bridge. The at least one second bridge has a cross-sectional area greater than the cross-sectional area of the first bridges. The link is formed by a separation line made along the bottom of the link and the top remaining material of the tamper band, the link remaining attached to the tamper band by the at least one second bridge when the plurality of first bridges is broken.

6 Claims, 4 Drawing Sheets

(56) References Cited

U.S. PATENT DOCUMENTS

| | | | | |
|---|---|---|---|---|
| 2006/0091100 | A1 | 5/2006 | Geho | |
| 2010/0326948 | A1* | 12/2010 | Campbell | B65D 55/16 215/258 |
| 2011/0114593 | A1 | 5/2011 | Ishii | |

* cited by examiner

TETHERED PLASTIC SCREW STOPPER

TECHNICAL FIELD

This invention relates to a tethered plastic screw stopper.

BACKGROUND

In the field of liquid packaging, it is very common to seal the aperture of a container with a stopper, often made from a plastic material. Such container is usually a plastic or glass bottle, but other materials may be used as well.

The stopper has a tubular shape closed at its top edge by a top wall. The stopper comprises a roof attached to a tamper shell through bridges. Bridges are distributed around the circumference of the roof and the tamper shall. The bridges may be made when molding the stopper or after through undergoing a cutting step during the manufacturing process.

Usually the bottle neck includes outer fixation feature, such as thread(s) for screw type stopper or annular fixation rings for snap type stopper, to secure the stopper on the bottle neck.

For screw type stoppers, the tamper shell comprises inner thread(s) arranged inside side walls. The bottle neck fixation feature may include outer thread(s). Such combination of outer and inner thread(s) allows the stopper to be screwed on a bottle neck to seal it and unscrewed for bottle opening. A snap type stopper may include an inner annular area and the bottle neck fixation feature may include outer fixation ring, in order to slot in force the stopper on the bottle neck. A snap type stopper may include a tamper shell with a movable sealing roof from a closed position to a partial opening position, and reversely. The roof may be separated upon opening or may be connected to the tamper shell.

In a bottle sealing position of the stopper, the tamper shell may be secured around the bottle neck through inner shell retaining features or through the retaining features diameter being smaller than a diameter of a tamper shell of the bottle neck.

The roof may be removable. During bottle opening, the bridges form a weakness line and may be torn apart from the roof, separating it from the bottle. The weakness line may be torn when user unscrews the tamper shell of the stopper or when user lifts the roof by tilting.

There is a recycling risk with separable roof as consumers may not always screw or snap back the roof onto the bottle neck once empty. The stopper may be thrown away as litter or put into the trash bin, or worse make its way into a landfill, which is not good in view of the environmental considerations.

One solution includes linking the roof to the tamper shell secured on the bottle neck, so the roof stays attached to the bottle after bottle opening. Such an attached stopper may be called a "tethered stopper."

U.S. Pat. No. 9,010,555 teaches a plastic screw stopper including a peripheral strip between a tamper shell and a roof. Such peripheral strip is linked to the tamper shell through a bottom weakness line and to the roof through a top weakness line. The bottom weakness line and top weakness line are parallel and extend across the periphery of the stopper in order to incorporate one or two hinges in close proximity to each other. When unscrewing the stopper the bottom weakness line and top weakness line tear apart, but the two hinges hold the roof on the tamper shell. The roof becomes unmovable and as capable of toggling around the hinges beside of the stopper secured on the bottle neck.

U.S. Pat. No. 8,490,805 teaches a plastic screw stopper comprises a helicoidal strip between a tamper shell and a roof. Such helicoidal strip is obtained by cutting the tamper shell around the stopper. The outer wall of the tamper shell is placed against a blade and the stopper is moved in rotation relative to the blade according to an angular stroke greater than an entire turn or more than 360°. During rotation, the stopper is being moved in an axial movement relative to the blade. The cut line forms a helicoidal weakness line which remains attached at one end to the tamper shell and at its opposite end to the roof after opening.

Other known art prior art systems include a tethered stopper comprising a spiral strip. The spiral strip is made during the stopper molding so there is no cutting or slitting operations. Other known prior art systems includes tethered stoppers comprising two strips linking the closure shell to the tamper band secured on the bottle.

SUMMARY

This invention is a tethered plastic screw stopper where its closure shell remains attached to its tamper band after bottle opening through a link formed into the ridge of the top edge of the tamper band. The link may be angularly made by molding or cutting into the material of the tamper band around the stopper and under a weakness line separating the closure shell from the tamper band. The link remains also connected to the closure shell at its opposite end through a remaining bridge which is not broken when unscrewing the closure shell when bottle opening.

DETAILED DESCRIPTION OF THE DRAWINGS

The figures are not necessarily to scale and some features may be exaggerated or minimized, such as to show details of particular components. Emphasis is placed on illustrating the principles of the invention. In the figures, like reference numerals designate corresponding parts throughout the different views.

DETAILED DESCRIPTION

Figure 1:
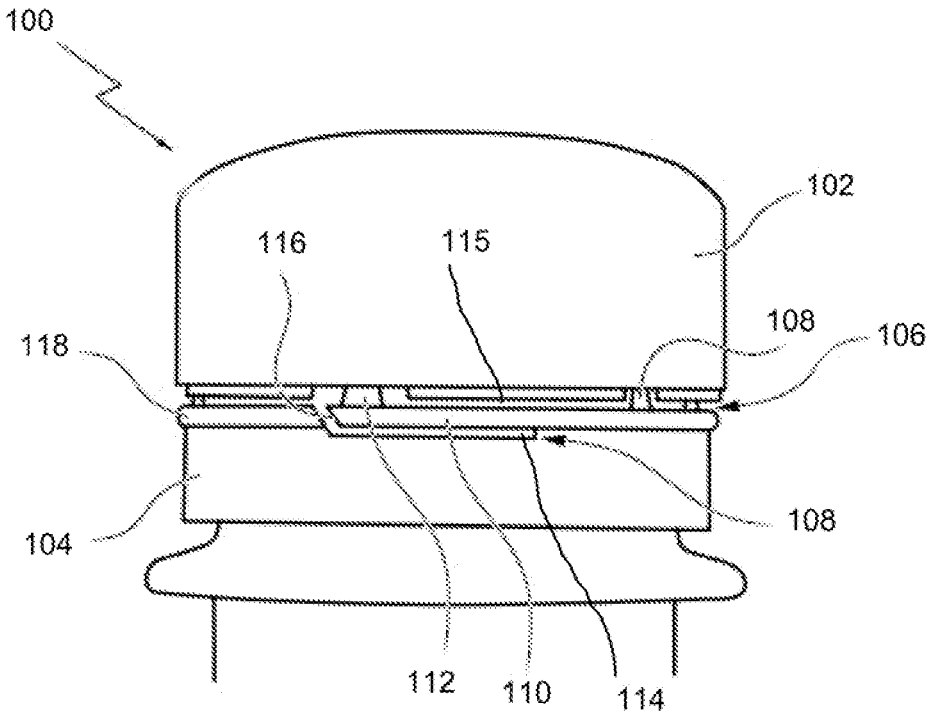
FIG. 1 is a diagrammatic lateral view of a tethered stopper in a closed position relative to the bottle.

As required, detailed embodiments of the present disclosure are disclosed herein. The disclosed embodiments are merely examples that may be embodied in various and alternative forms, and combinations thereof. As used herein, for example, exemplary, and similar terms, refer expansively to embodiments that serve as an illustration, specimen, model or pattern.

In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Phrasing such as 'configured to' perform a function, including in the claims, can include any or all of being sized, shaped, positioned in the arrangement, and comprising material to perform the function.

Terms indicating quantity, such as 'first' or 'second' are used for exemplary and explanation purposes and are not intended to dictate the specific ordering of a component with respect to other components. Terms indicating position such as 'top' or 'bottom' and 'left' or right' are used for exemplary and explanation purposes with respect to other components.

Various embodiments of the present disclosure are disclosed herein. The described embodiments are merely exemplary illustrations of implementations set for a clear understanding of the principles of the disclosure. Variations, modifications, and combinations may be made to the described embodiments without departing from the scope of the claims. All such variations, modifications, and combinations are included herein by the scope of this disclosure and the claims.

This invention is a tethered plastic screw stopper 100 for closing a bottle. The stopper 100 may be formed by one plastic piece by a molding fabrication step. Other parts or elements of the stopper 100 can be further formed into the plastic piece by cutting or slitting manufacturing step. The stopper 100 is a screw type and comprises inner fixation features, such as thread(s), designed to cooperate with outer complementary fixation features made on the bottle neck.

The stopper 100 comprises a closure shell 102 and a tamper band 104 underneath the closure shell 102. Positioned at the bottom edge the tamper band 104 are the retaining features. The retaining features act to secure the stopper 100 when sealing the bottle. Additionally, the retaining features can be made to form a collar. After the collar is inverted inside the tamper band 104, during the bottle sealing process the collar locks the tamper band 104 and the stopper 100 against a tamper evident ring positioned outwardly around the bottle neck. The retaining features can also be molded directly during the injection process resulting in beads that do not need to be inverted like the collar.

Tamper band 104 and the closure shell 102 are separably connected together through a weakness line 106. The weakness line 106 is positioned between the bottom edge of the closure shell 102 and the top edge of the tamper band 104. The weakness line 106 may be formed into the plastic material of the stopper 100 when molding or through a further cutting operation. The weakness line 106 is formed and comprises bridges 108. These bridges 108 are distributed along the weakness line 106, in regular or irregular spacing. The bridges 108 link the top edge of the tamper band 104 to the bottom edge of the closure shell 102. Between the bridges 108, the weakness line 106 comprises spaces or slitting material, with a less thickness, which allow the closure shell 102 to be removed from the tamper band 104 when opening the bottle by unscrewing the stopper 100. Thus, when unscrewing the closure shell 102 from the tamper band 104, the bridges 108 are broken. So the closure shell 102 can be manually removed by the consumer, in order to open the bottle and access the bottle's contents.

The stopper 100 is tethered and when the bottle is opened, the closure shell 102 remains attached to the tamper band 104 and is secured on the bottle neck by its retaining features. The stopper 100 comprises a link 110 formed into a ridge 118 on the upper area of the tamper band 104. Typically, the ridge 118 has a greater thickness relative to the tamper band 104. The link 110 has a small portion of the upper area of the tamper band 104 or of its top edge.

Separation lines 114,115 is formed respectively along the bottom and top of the link 110 and the top of the remaining material of the tamper band 104. At one end, the link 110 remains connected to the tamper band 104. One or more of the separation lines 114, 115 angularly extends to determine the length of the link 110. The separation line 114 can be made of a less thick material or of space bridges or of at least one bridge, so when unscrewing the closure shell 102 the separation line 114 is torn apart and allows the link 110 to separated from the tamper band 104.

Figure 2:
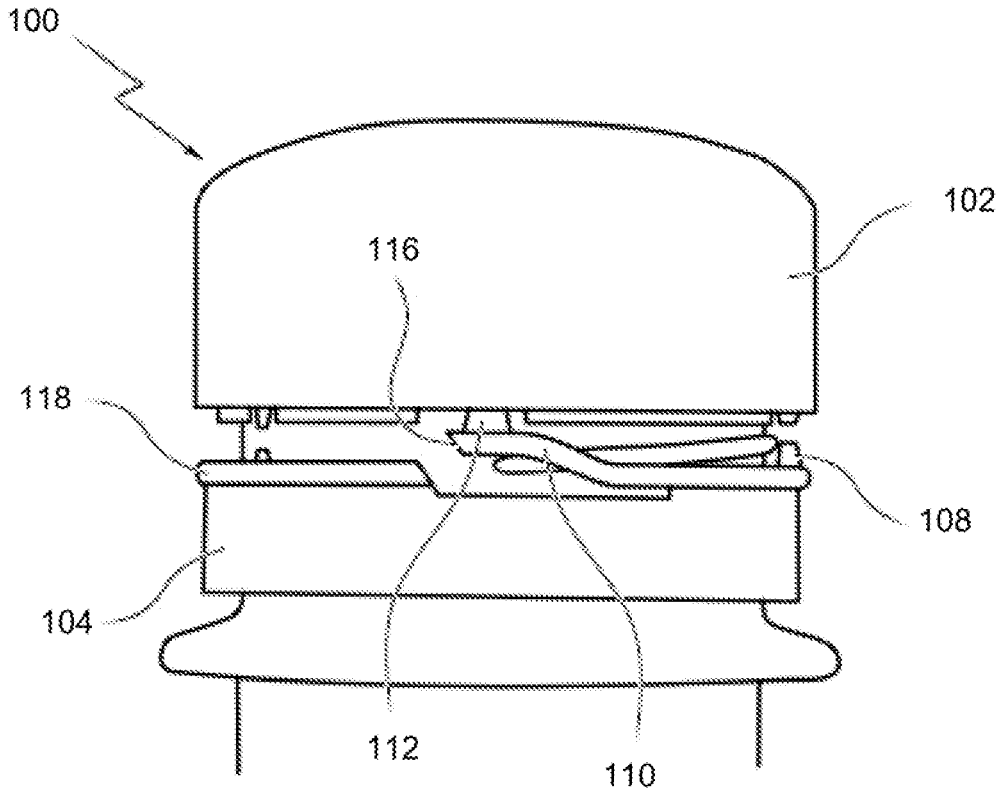
FIG. 2 is a diagrammatic lateral view of the embodiment of FIG. 1 where the tethered stopper is unscrewed into a first opening step.
Figure 3:
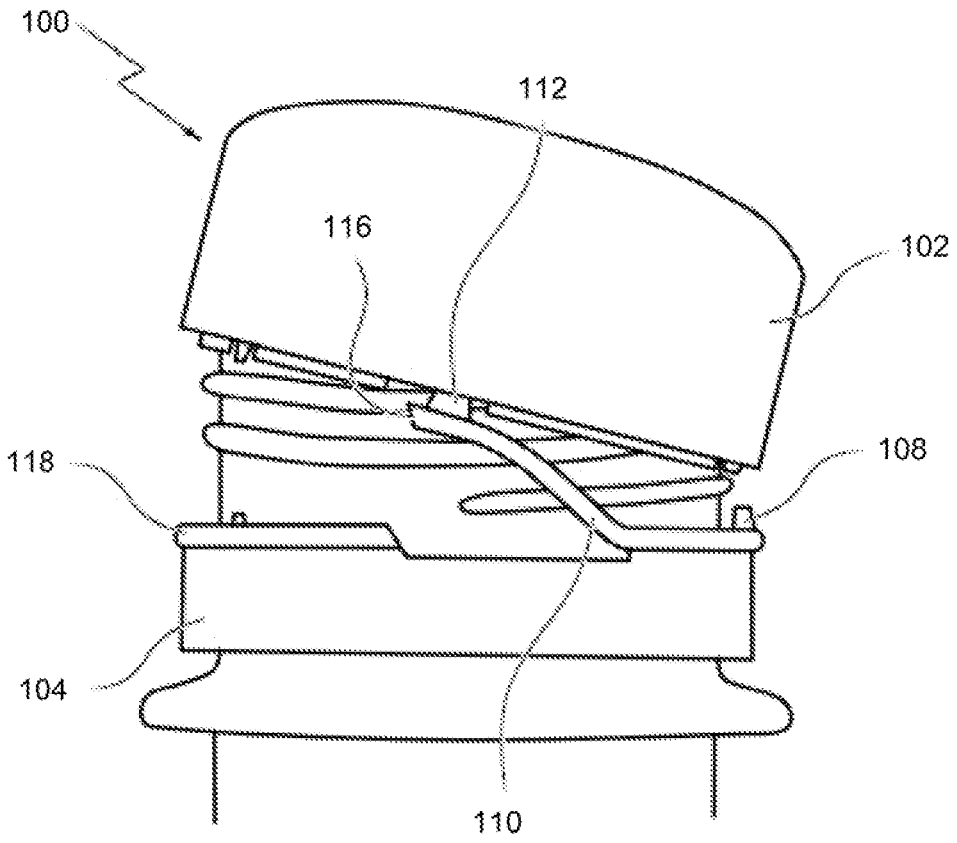
FIG. 3 is a diagrammatic lateral view of FIG. 1 where the tethered stopper is unscrewed into a second opening step.
Figure 4:
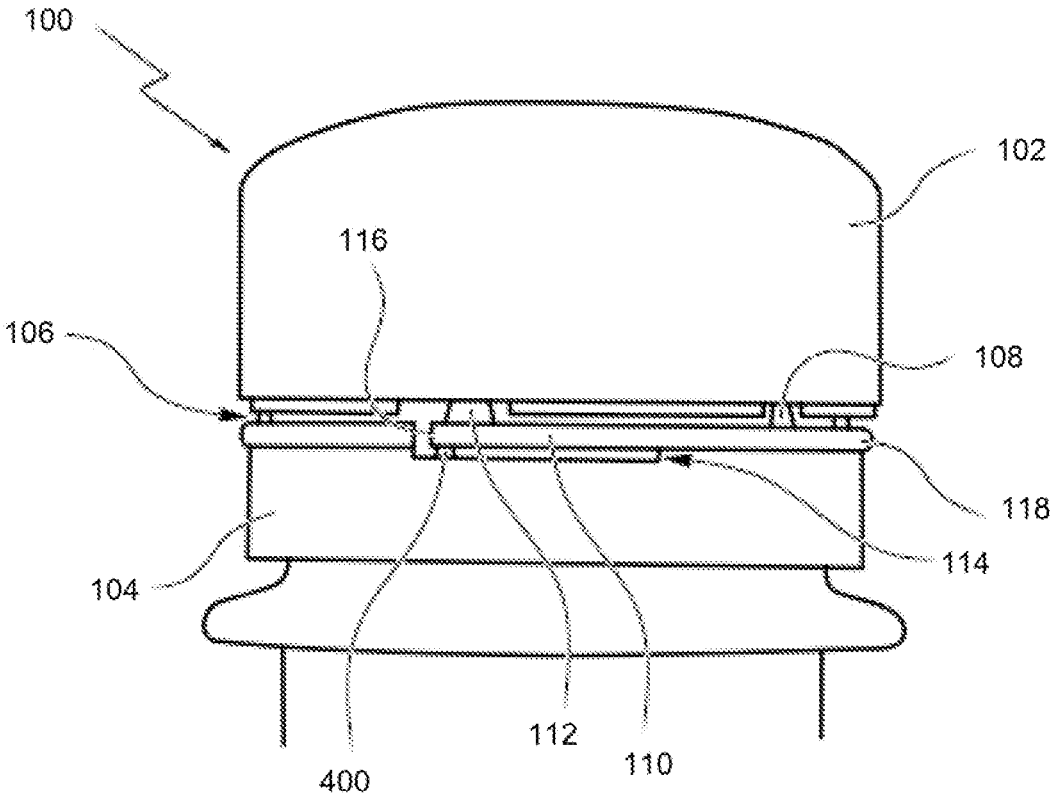
FIG. 4 is a diagrammatic lateral view of a tethered stopper in a closed position.

According to an embodiment, the link 110 angularly extends around the stopper 100 into the tamper band 104 between 10° to 350°. According to one embodiment the link 110 angularly extends at 180°. The bottom separation line 114 of the link 110 is formed during the stopper 100 manufacturing process or by a cutting or slitting during the manufacturing process. An opposite end 116 of the link 110 may also be separated from the ridge 118 by a space. In some embodiments as shown in FIGS. 1, 2 and 3, the opposite end edge 116 may be inclined or curved. In other embodiments as shown in FIG. 4, the opposite end edge 116 is vertical.

In some embodiments, the bottom separation line 114 comprises a breakable bridge 400 (FIG. 4) under the opposite end 116. The breakable bridge 400 may be designed to secure the opposite end 116 of the link 110 when first applying the stopper 100 to the bottle (e.g., during manufacturing). The breakable bridge 400 is torn apart and separates when unscrewing the closure shell 102 (e.g., by a user opening the bottle), releasing the opposite end 116 of the link 110.

At its top end, the link 110 may be attached to the closure shell 102 through at least one of the bridges 108 which does not break when unscrewing the closure shell 102, relative to the other bridges 108 which are torn and broken when unscrewing the closure shell 102. So when the bottle is opened, the opposite end of the link 110 remains attached to the closure shell through the at least one remaining bridge 112. The remaining bridge 112 is shown in FIGS. 2 and 3 after opening the bottle.

The remaining bridge 112 is configured to retain connection between the link 110 and the bottom edge of the closure 102. In some embodiments, the remaining bridge 112 be integrally formed (e.g., during molding) as a part of the link 110. In other embodiments, the remaining bridge 112 is formed independent from the link 110 and subsequently attached to the link 110 (e.g., during a manufacturing operation).

In another embodiment, multiple remaining bridges 112 are not broken and are still attached at the link opposite end to the closure shell 102. The at least two remaining bridges 112, close to each other, stay attached to the closure shell 102. In some embodiments, the additional remaining bridge is located diametrically opposed to the remaining bridge 112 (i.e., 180 opposite of the remaining bridge 112. In some embodiment, the second remaining bridge is formed at the location of a normal bridge 108. Specifically, the second remaining bridge would replace the normal bridge 108.

The remaining bridge 112 has a greater thickness and/or cross-sectional area relative to the other breakable bridges 108. For example, the thickness and/or the cross-sectional area of the remaining bridge 112 is at least 30% greater than the respective thickness and cross-sectional area of the normal bridges 108. As another example, the thickness and/or the cross-sectional area of the remaining bridge 112 is 150% or 200% of the section of the normal bridges 108.

In one embodiment, the bridges 108 and/or the remaining bridge 112 have a square or rectangular shape, so the section of the remaining bridge 112 has a length and/or a width greater than the length and/or width of the bridges 108. In another embodiment, the bridges 108 and/or the remaining bridge 112 have a circular or cylindrical or conical shape, so the section of the remaining bridge 112 has a diameter greater than the diameter of the bridges 108. In some embodiments, the cross-sectional shape of the bridge 108 differs from the cross-sectional shape of the remaining bridge 112.

While various embodiments of the invention have been described, it will be apparent to those of ordinary skill in the art that many more embodiments and implementations are possible that are within the scope of this invention.

What is claimed is:

1. A tethered plastic screw stopper, comprising:

a closure shell a tamper band connected to the closure shell by a plurality of breakable bridges that connect a bottom edge of the closure shell to a top edge of the tamper band, the upper portion of the tamper band comprising a ridge; and the ridge forming a link that separably connects the closure shell and the tamper band by a weakness line containing the plurality of breakable bridges and at least one non-breaking bridge, wherein the at least one non-breaking bridge has a cross-sectional area greater than the cross-sectional area of the breakable bridges and is located near a free end of the link to connect the top edge of the link to the bottom end of the closure shell, wherein the link is formed by a separation line made along the bottom of the link and remaining material along the top edge of the tamper band, the link remaining attached to the tamper band by the at least one non-breaking bridge when the plurality of breakable bridges is broken.

2. The tethered plastic screw stopper according to claim 1, wherein there are at least two non-breaking bridges diametrically opposed, each configured to remain attached to the closure shell and allow the link to remain attached to the tamper band.

3. The tethered plastic screw stopper according to claim 1, wherein the cross-sectional area of the non-breaking bridge is 30% greater than the cross-sectional area of the first bridges.

4. The tethered plastic screw stopper according to claim 1, wherein the link angularly extends around the stopper into the tamper band between 10° to 350°.

5. The tethered plastic screw stopper according to claim 1, wherein the link angularly extends around the stopper into the tamper band at 180°.

6. The tethered plastic screw stopper according to claim 1, further comprising a second non-breaking bridge along the top edge of the tamper band.

* * * * *